US005636241A

United States Patent [19]

Yamada et al.

[11] Patent Number: 5,636,241

[45] Date of Patent: Jun. 3, 1997

[54] LEVITATION MELTING CRUCIBLES

[75] Inventors: Junji Yamada, Nagoya; Noboru Demukai, Kaizu-gun, both of Japan

[73] Assignee: Daido Tokushuko Kabushiki Kaisha, Aichi, Japan

[21] Appl. No.: 641,519

[22] Filed: May 1, 1996

[30] Foreign Application Priority Data

May 19, 1995 [JP] Japan ..... 7-145538

[51] Int. Cl.[6] ..... H05B 6/22

[52] U.S. Cl. ..... 373/156; 373/157; 219/648

[58] Field of Search ..... 373/45, 75, 76, 373/85, 138, 139, 146, 155, 156, 158; 219/648; 75/10.14, 10.15

[56] References Cited

U.S. PATENT DOCUMENTS 3,702,368 11/1972 Hukin ..... 373/156

3,775,091 11/1973 Clites et al. ..... 75/10.14

5,058,127 10/1991 Garnier et al. ..... 373/157

5,394,432 2/1995 Fukuzawa et al. ..... 373/156

*Primary Examiner*—Tu B. Hoang

*Attorney, Agent, or Firm*—Koda and Androlia

[57] ABSTRACT

Disclosed is a levitation melting crucible which can facilitate penetration of magnetism into the crucible and which can prevent a molten metal from being contaminated by an insulating material. The levatation melting crucible comprises a cylindrical main body having a closed bottom, a plurality of slits defined vertically in the circumferential wall of the main body to open inward and outward at predetermined intervals in the circumferential direction and an insulating material filled in each of the slits; wherein each slit is designed to have an inner opening width smaller than its outer opening width, with respect to the radius of the main body, for example, 1.5 A>B.

2 Claims, 4 Drawing Sheets

LEVITATION MELTING CRUCIBLES

BACKGROUND OF THE INVENTION

1. Field of the Invention

The present invention relates to a levitation (electromagnetic) melting crucible. More particularly, the present invention relates to a crucible to be employed for levitation melting, in which a metallic material introduced to the crucible is melted in no contact with the inner wall surface of the crucible to give a contaminant-free molten metal.

2. Description of the Related Art

There is known the levitation melting method as a melting method which can prevent, when a metallic material of various kinds introduced to a melting crucible is to be melted therein, the resulting molten metal from being contaminated due to chemical reactions occurring when it is brought into contact with the inner wall surface of the crucible and which can thus achieve improvement in the quality of molten metal. In this levitation melting method, the molten metal formed in the crucible is levitated by an electromagnetic force to be in no contact with the inner wall surface of the crucible so as to prevent migration of contaminants from the crucible into the molten metal.

FIG. 8 shows a crucible employable in the levitation melting method. The crucible 10 has a cylindrical main body 10 with a closed bottom, the circumferential wall of which contains a plurality of vertical slits 14 defined at predetermined intervals in the circumferential direction to divide the circumferential wall into several segments 16. These segments 16 are designed to be electrically insulated from one another by an insulating material 18 such as a refractory ceramic filled in the slits 14. Induction coils 20 are disposed to surround the crucible 10, and when a high-frequency current is applied to these coils 20, a material 22 introduced into the crucible 10 is heated and melted, and also the thus obtained molten metal 22*a* is designed to be levitated to be in no contact with the inner wall surface of the crucible 10 by the electromagnetic force penetrating into the crucible. Incidentally the reference number 11 shown in FIG. 8 denotes a solidified portion of the material 22.

In the levitation melting crucible 10 described above, it is advantageous to secure a large opening width for the slits 14 in order to facilitate penetration of magnetism into the crucible 10 and to ensure levitation of the molten metal 22*a* in no contact with the inner wall surface of the crucible 10. However, if a large opening width is secured for the slits 14, the area of the insulating material 18 packed in the slits to be exposed to the inside of the crucible is enlarged. Accordingly, when an active metal having a high melting point such as titanium is to be melted, the molten active metal is readily brought into contact with the insulating material 18, leading to increased liability to contamination to be caused by chemical reactions with the insulating material 18. More specifically, in the standpoint of preventing contamination of the molten metal, it is advantageous to secure a small opening width for the slits 14. It should be noted here that, when a small opening width is secured for the slits 14, the operation of packing the insulating material 18 into the slits 14 becomes difficult to lower working efficiency, disadvantageously.

As described above, in order to fully achieve both improvement in penetration of magnetism into the crucible and prevention of contamination of the molten metal, both of these contradictory requirements described above must be satisfied. However, the prior art crucible cannot be said to have overcome both of these requirements but one of them is laid aside under the present circumstances.

SUMMARY OF THE INVENTION

The present invention is proposed in view of the problems inherent in the levitation melting crucible described above and for the purpose of solving them successfully, and it is an objective of the present invention to provide a levitation melting crucible, which can achieve excellent penetration of magnetism into the crucible, which can prevent contamination of the molten metal to be caused when brought into contact with the insulating material packed in the slits from occurring, and which can improve workability of packing the insulating material into the slits.

In order to overcome the problems described above and to attain the intended objective, the present invention provides a levitation melting crucible comprising a cylindrical main body having a closed bottom, a plurality of slits defined vertically in the circumferential wall of the main body to open inward and outward at predetermined intervals in the circumferential direction and an insulating material □ filled in the slits; wherein each of the slits is designed to have an inner opening width smaller than its outer opening width, with respect to the radius of the main body.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

DETAILED DESCRIPTION OF THE PREFERRED EMBODIMENT

Figure 8:
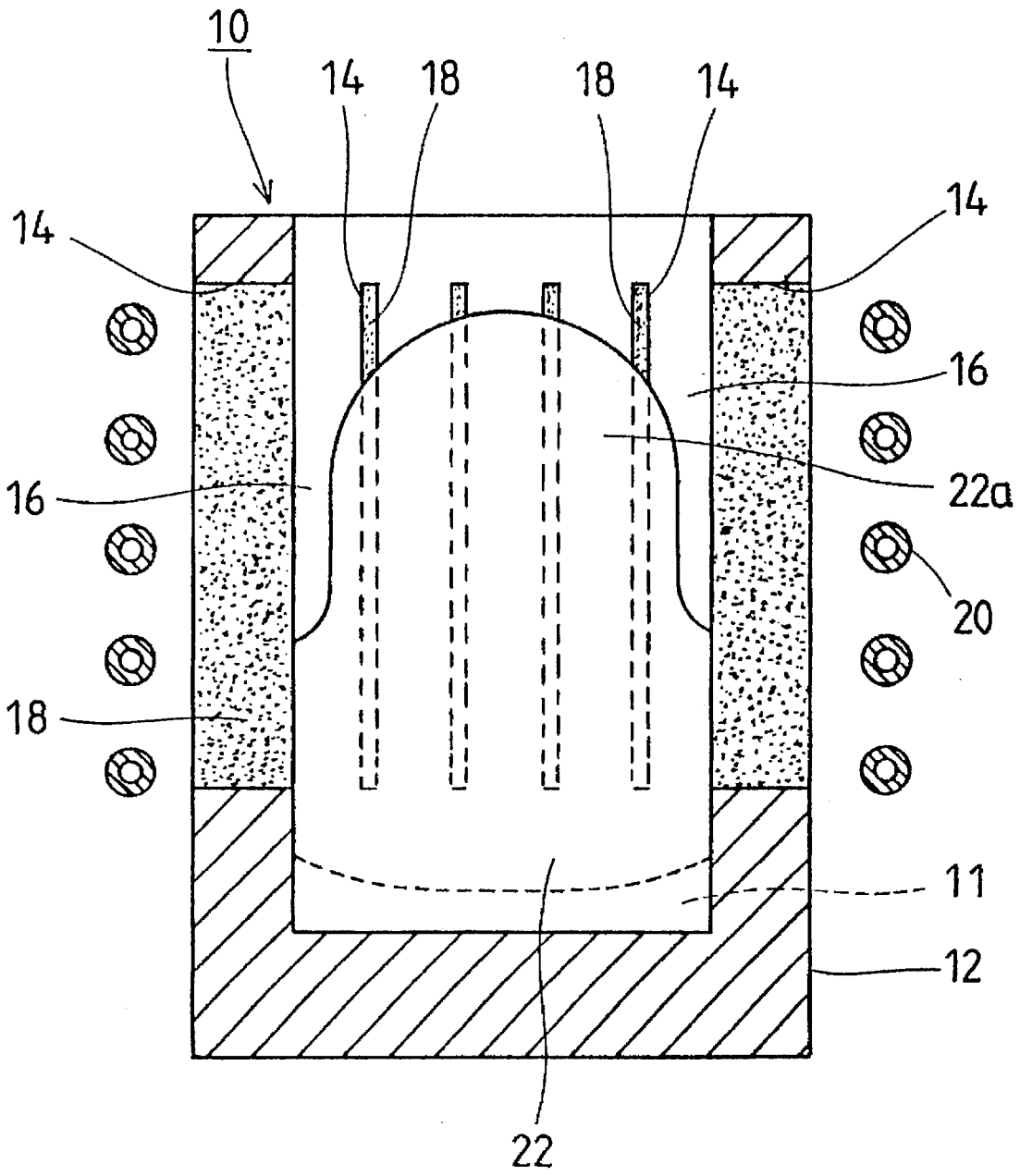
FIG. 8 PRIOR ART
FIG. 8 is a vertical cross-sectional view of a prior art levitation melting crucible.

Next, the levitation melting crucible according to the present invention will be described below in detail by way of a preferred embodiment referring to the attached drawings. It should be noted here that the similar parts as those described in the paragraph of prior art referring to FIG. 8 are affixed with the same reference numbers, respectively.

Figure 1:
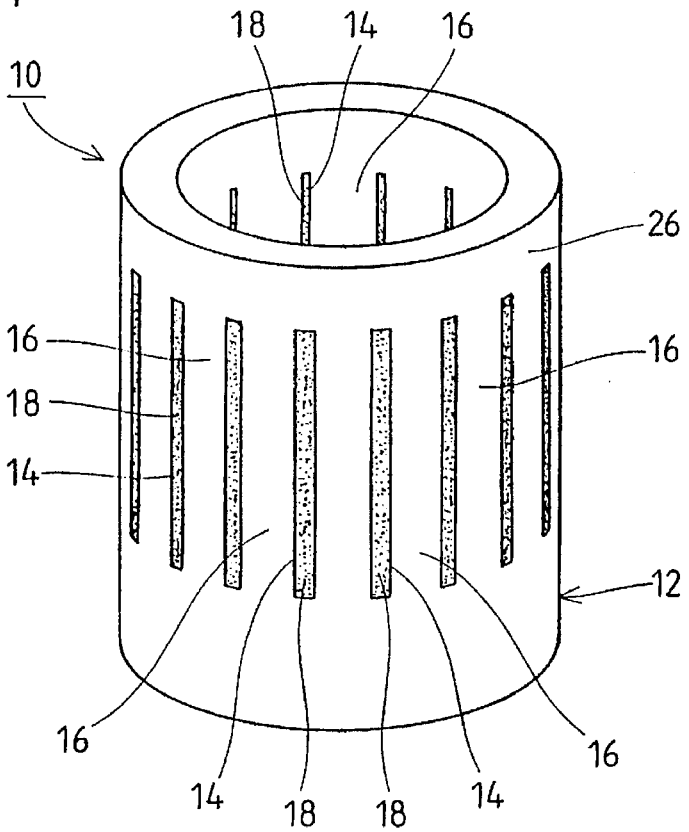
FIG. 1 is a schematic perspective view of a levitation melting crucible according to a preferred embodiment of the present invention.
Figure 2:
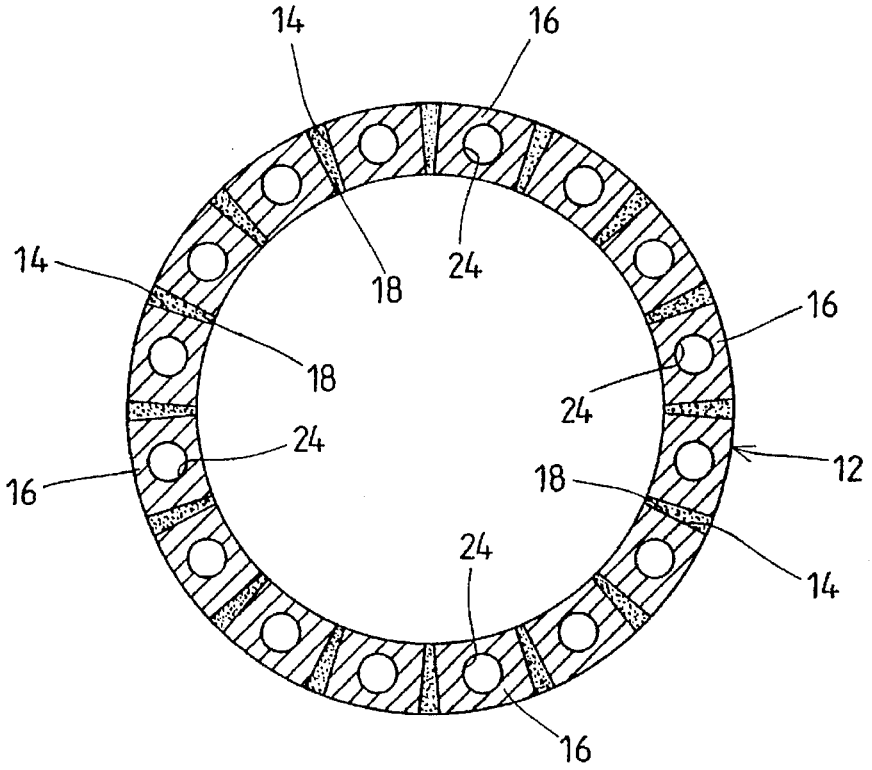
FIG. 2 is a horizontal cross-sectional view of the levitation melting crucible according to the embodiment of the present invention.

FIG. 1 is a perspective view showing schematically the constitution of the levitation melting crucible 10 according to a preferred embodiment of the present invention. The crucible 10 is, for example, made of copper and has a cylindrical main body 12 with a closed bottom, the circumferential wall of which contains a plurality of slits 14 defined vertically at predetermined intervals in the circumferential direction. Each slit 14 opens inward and outward in the radial direction of the main body 12 and has a predetermined length in the axial direction of the main body 12, so that the main body 12 may consist of several vertically divided sectorial segments 16 defined by the slits 14 (see FIG. 2). Further, each slit 14 is filled with an insulating material 18 such as a refractory ceramic, and thus each segment 16 is electrically insulated from the other segments 16.

Figure 3:
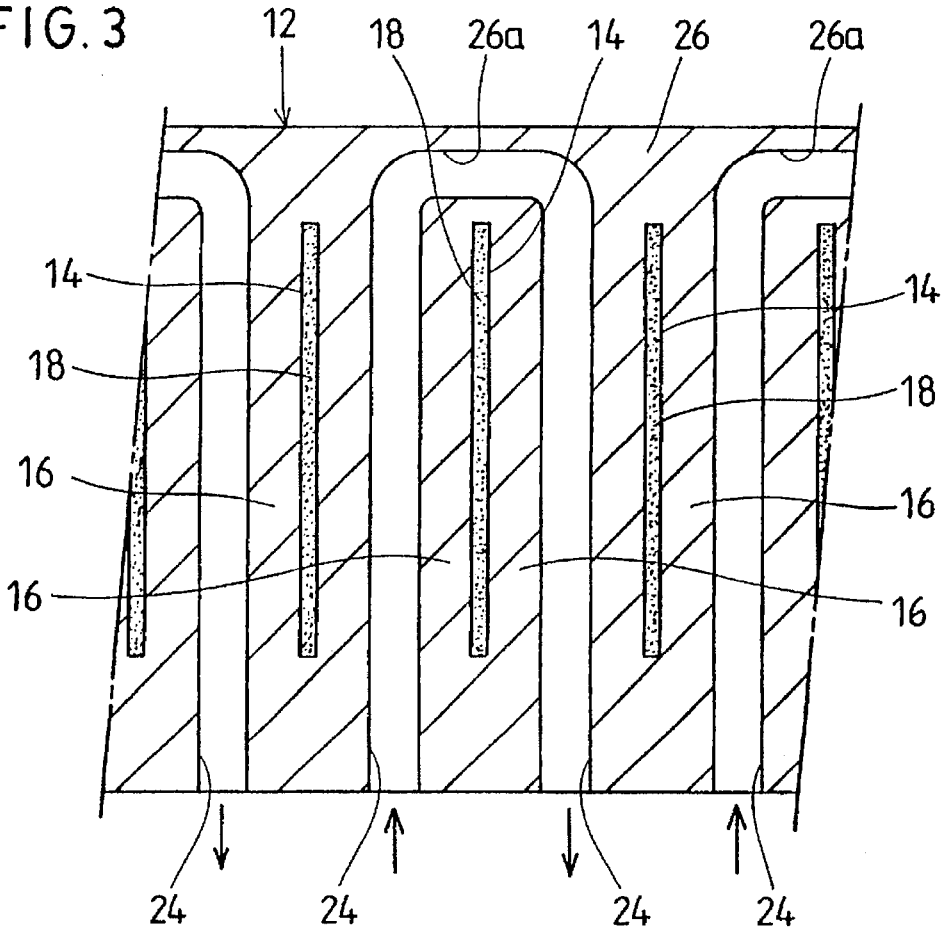
FIG. 3 is a vertical cross-sectional view of the levitation melting crucible according to the embodiment of the present invention.

Cooling water passages 24 are defined parallel to the slits 14 in the respective segments 16, as shown in FIG. 3, such that the passages 24 in each adjacent pair of segments 16 situated on each side of a slit 14 may communicate with each other via a connecting passage 26*a* defined in an upper connected portion 26 of the main body 12 where no slits are formed. Further, the passage 24 defined in one segment 16 in each pair communicates to a cooling water supply source (not shown), so that a cooling water may be circulated to the passages 24 to cool the crucible 10.

Figure 4:
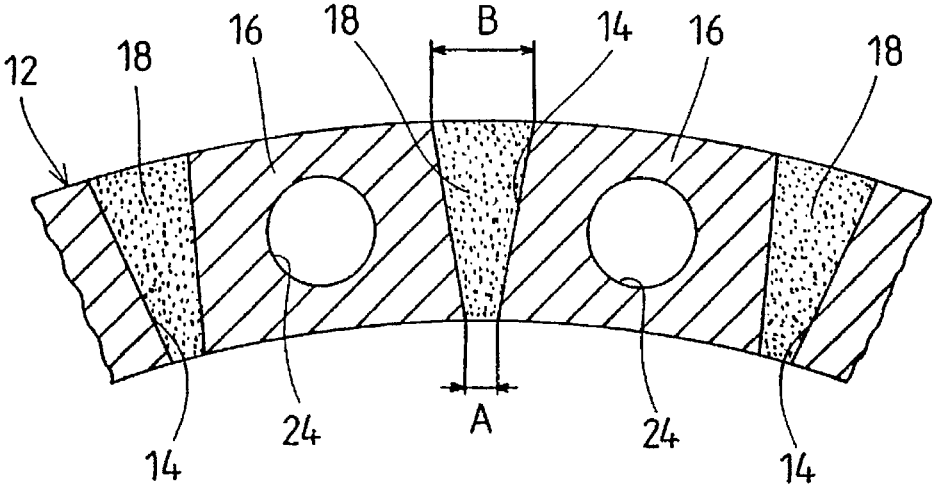
FIG. 4 is a horizontal cross-sectional view of the major portion of the levitation melting crucible according to the embodiment of the present invention.

As shown in FIG. 4, each slit 14 is defined to have a wedge-like horizontal cross section such that the opening width increases radially outward. More specifically, a relationship of A<B is established between the inner opening width A and the outer opening width B of each slit 14 with respect to the radial direction of the main body 12. In order to fully achieve improvement in penetration of magnetism into the crucible 10 and prevention of contamination of the molten metal 22*a*, it is recommended to set the opening width A and the opening width B to satisfy a relationship of 1.5 A<B, provided that A<2 mm.

In the crucible 10 containing slits 14 having such dimensions, the outer opening width B of the slit 14 has a width sufficient to allow penetration of magnetism into the crucible 10. Besides, since the outer opening width B of the slit 14 is large enough to facilitate packing of the insulating material 18 into the slits 14, packing workability can be improved. Further, since the inner opening width A of the slit 14 is small, the area of the insulating material 18 to be exposed to the inside of the crucible 10 becomes small, and thus the molten metal 22*a* is prevented from being contaminated by the insulating material 18 when brought into contact with it.

(Variations)

Figure 5:
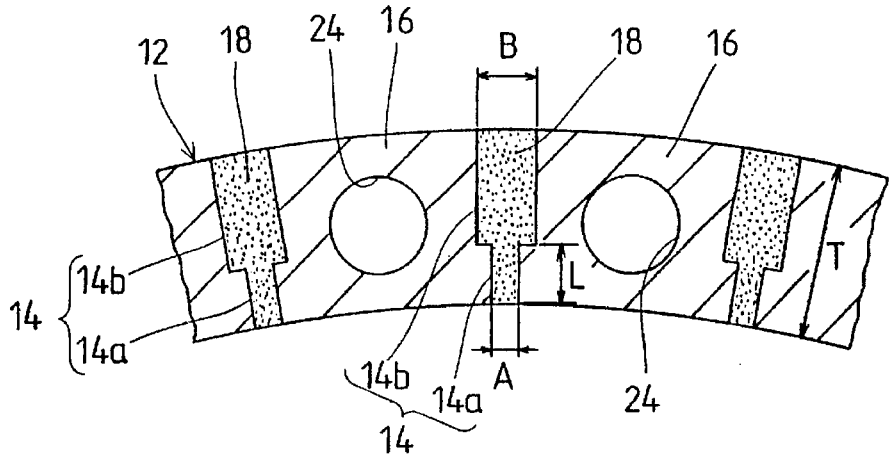
FIG. 5 is a partial horizontal cross-sectional view showing a variation of the slits in the levitation melting crucible according to the embodiment of the present invention.
Figure 6:
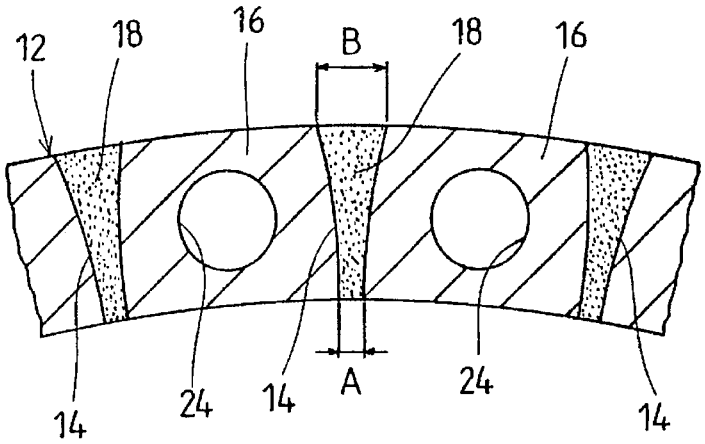
FIG. 6 is a partial horizontal cross-sectional view showing another variation of the slits in the levitation melting crucible according to the embodiment of the present invention.
Figure 7:
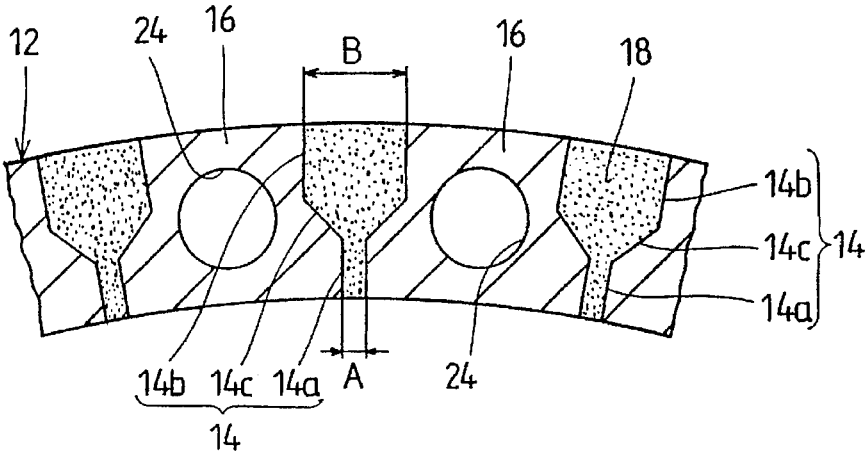
FIG. 7 is a partial horizontal cross-sectional view showing another variation of the slits in the levitation melting crucible according to the embodiment of the present invention.

FIGS. 5 to 7 show variations of the slits 14 in the crucible 10. In the variation shown in FIG. 5, each slit 14 is composed of a first opening portion 14*a* which is extended radially with an opening width A to open inward and a second opening portion 14*b* which is extended radially with an opening width B to communicate to the first opening portion 14*a* and to open outward. In this case, the opening width A and the opening width B are set to satisfy a relationship of A<B. It is recommended to set the length L of the first opening portion 14*a* relative to the wall thickness T of the segments 16 in the main body 12 such that they may satisfy a relationship of L<⅔ T.

Meanwhile, in the variation shown in FIG. 6, the opening width of the slits 14 is designed to be increased radially outward, and the opposing wall surfaces in each slit 14 are arcuated. Further, in the variation shown in FIG. 7, each slit 14 is composed of a first opening portion 14*a* which is extended radially with an opening width A to open inward and a second opening portion 14*b* which is extended radially with an opening width B to open outward, which are allowed to communicate with each other via a tapered portion 14*c*. In this case, the opening width A and the opening width B are again set to satisfy the relationship of A<B. In the thus constituted variations, magnetism penetrates well into the crucible, and also the molten metal can be prevented from being contaminated.

It should be noted that the main body 12 has a cylindrical form in the levitation melting crucible 10 according to the preferred embodiment, it may have a rectangular or polygonal tubular form. The number of slits 14 and the intervals between the slits 14 can be arbitrarily selected depending on the capacity of the material to be melted in the melting crucible 10.

Only one embodiment of the present invention has been described herein, it should be apparent to those skilled in the art that the present invention may be embodied in many other specific forms without departing from the spirit or scope of the invention. Therefore, the present examples and embodiment are to be considered as illustrative and not restrictive, and the invention is not to be limited to the details given herein, but may be modified within the scope of the appended claims.

What is claimed is:

1. A levitation melting crucible comprising a cylindrical main body having a dosed bottom, a plurality of slits defined vertically in the circumferential wall of said main body to open inward and outward at predetermined intervals in the circumferential direction and an insulating material filled in said slits;

wherein each of said slits is designed to have an inner opening width smaller than its outer opening width, with respect to the radius of said main body.

2. The levitation melting crucible according to claim 1, wherein said inner opening width A and said outer opening width B in said slit are designed to satisfy a relationship of 1.5 A<B.

* * * * *